US005921110A

United States Patent [19]

Middendorff et al.

[11] Patent Number: 5,921,110

[45] Date of Patent: Jul. 13, 1999

[54] INTERCHANGEABLE JEWELRY ASSEMBLY

[75] Inventors: Suzanne B. Middendorff, 7633 Silver Fern Blvd., Sarasota, Fla. 34241; Randal L. Vap, Cincinnati, Ohio

[73] Assignee: Suzanne B. Middendorff, Sarasota, Fla.

[21] Appl. No.: 08/854,771

[22] Filed: May 12, 1997

Related U.S. Application Data

[63] Continuation of application No. 08/439,692, May 12, 1995, abandoned, which is a continuation-in-part of application No. 08/271,529, Jul. 7, 1994, abandoned.

[51] Int. Cl.[6] ..... A44C 1/00; A44C 7/00; A44C 25/00

[52] U.S. Cl. ..... 63/1.11; 63/1.18; 63/12; 63/20; 63/23

[58] Field of Search ..... 63/1.11, 1.18, 63/20, 23, 40

[56] References Cited

U.S. PATENT DOCUMENTS

| | | | |
|---|---|---|---|
| D. 31,432 | 8/1899 | Washburne . | |
| D. 116,713 | 9/1939 | Lake . | |
| 148,390 | 3/1874 | Tappan . | |
| 1,938,206 | 12/1933 | Bigney . | |
| 2,038,343 | 4/1936 | Candas . | |
| 2,080,060 | 5/1937 | Placco . | |
| 2,087,331 | 7/1937 | Placco . | |
| 2,128,319 | 8/1938 | Pulver | 63/20 |
| 2,144,375 | 1/1939 | Huppert | 63/20 |
| 2,225,890 | 12/1940 | Schwarzkopf . | |
| 2,274,269 | 2/1942 | Jellinek . | |
| 3,357,063 | 12/1967 | Ebben . | |
| 3,605,438 | 9/1971 | Chalson . | |
| 3,850,010 | 11/1974 | Noto | 63/2 |
| 4,276,757 | 7/1981 | Boening | 63/1.1 |
| 4,377,939 | 3/1983 | Reinsdorf . | |
| 4,400,932 | 8/1983 | Epstein . | |
| 4,655,054 | 4/1987 | Roesch . | |
| 4,727,883 | 3/1988 | Moody . | |
| 4,763,489 | 8/1988 | Strong . | |
| 4,817,064 | 3/1989 | Miles . | |
| 4,879,882 | 11/1989 | Johnson et al. . | |
| 5,044,175 | 9/1991 | Razza . | |
| 5,161,390 | 11/1992 | Sam . | |
| 5,165,257 | 11/1992 | Corenblith . | |
| 5,245,844 | 9/1993 | Panzer . | |

FOREIGN PATENT DOCUMENTS

| | | |
|---|---|---|
| 2478230 | 3/1980 | France . |
| 4016334 | 8/1991 | Germany . |

*Primary Examiner*—Kien T. Nguyen
*Attorney, Agent, or Firm*—Dinsmore & Shohl LLP

[57] ABSTRACT

An interchangeable jewelry assembly is provided which includes at least one jewelry element having a first side and a second side that is adapted for attaching to other jewelry elements or to jewelry support devices. A post is pivotally mounted on the second side such that it has at least two predetermined positions, an extended position for insertion into a pierced body part or fabric, and a retracted position whereby the post is substantially parallel and adjacent to the second side. A catch device also is located on the second side for fastening the free end of the post to the second side when the post is in its retracted position. When the post is fastened to the catch device, a loop is formed which may be used to attach the jewelry element to other jewelry support devices.

15 Claims, 5 Drawing Sheets

INTERCHANGEABLE JEWELRY ASSEMBLY

This is a continuation of application Ser. No. 08/439,692, filed May 12, 1995; which is a continuation-in-part of application Ser. No. 08/271,529, filed Jul. 7, 1994, both now abandoned.

TECHNICAL FIELD

The present invention relates to jewelry, and more particularly, to an interchangeable ornamental jewelry assembly that enables an individual ornamental jewelry element to be selectively attached to other ornamental jewelry elements and/or jewelry support devices.

It is widely practiced custom throughout many areas of the world for women and, in some instances, for men to wear ornamental jewelry. Typically, each ornament is singularly dedicated for use as only one type of jewelry piece. Jewelry may take a variety of different forms, and may either be worn directly attached to a wearer, as for example in the case of earrings, may be attached to a wearer's clothes by a fastening element such as a pin, or a broach, which may be attached to the lapel of a jacket worn by the user, or may be worn around a portion of the user, such as a bracelet, necklace, anklet, ring or even a belt. Although it is common to have a set of different, but matching jewelry pieces having some common characteristics, each of the different jewelry pieces in a set generally has its own ornament and is structurally and functionally independent from the other pieces in the set.

Although the practice of using singularly dedicated jewelry ornaments is quite acceptable for relatively inexpensive costume jewelry, it has serious economic consequences for fine jewelry where the cost of the jewelry ornament is more expensive. In some cases, the high economic costs of fine jewelry ornaments has significantly limited the sales potential for such ornaments since typically, the jewelry ornament is designed and may be worn only for the singular dedicated use. Consequently, the per use economic cost of the jewelry is extraordinarily high for those pieces having expensive jewelry ornaments.

There have been attempts to make jewelry pieces that are not dedicated to a single use, but may be interchangeable assemblies. However, for the most part, the interchangeability in products resulting from these attempts has been limited to interchanging a plurality of different ornaments on a particular and specific type of fastening element. The structures resulting from these efforts do little to address the economic problems associated with the use of expensive jewelry ornaments. Instead of permitting several uses for a single ornament, these efforts have generally permitted only the use of multiple ornaments with one or several fastening elements. Previous shortcomings of prior jewelry assemblies are that different types of jewelry pieces are supported in different ways, and it has been difficult to design a fastener capable of accommodating such diverse requirements.

It is well known to provide a common earring on which a plurality of different decorative ornaments may be detachably mounted. Earrings also are known that allow additional ornaments to be added to the earring by an adapter, which are generally visible and can detract from the aesthetic value of the jewelry. Another example of previous interchangeable devices provide a loop that is located on the non-decorative side of a jewelry element for attaching a support device, such as an earring attachment, to form an earring that "dangles" from the attachment. Earrings adapted in this matter are unattractive since the earring attachment is visible and causes the jewelry element to dangle at an awkward angle from the wearer's ear.

Pins or pendants have a loop threading various necklaces or bracelets therethrough are well known in the art. Stick pins typically have a decorative portion which may be detached and used as a necklace or bracelet, or which may be used as a pierced earring. Previously, pin/pendent ornaments have not had utility as earrings, because in order to obtain a pair of earrings, two stick pins must be purchased.

Traditional post earrings have not been available that lay flat on the wearer's ears and are capable of adapting to other types of jewelry. Furthermore, previous interchangeable jewelry devices have an earring fastening structure that is separate from the decorative portion of the jewelry piece; thus, if the earring fastening structure is lost, it must be replaced in order for the decorative portion to have a utility as an earring. There is a need for a more versatile interchangeable jewelry assembly, and more specifically, for a jewelry element that functions as an earring without requiring a separate earring attachment, but also can function as other jewelry pieces.

SUMMARY OF THE INVENTION

Accordingly, it is a primary object of the present invention to provide an aesthetically pleasing interchangeable jewelry assembly which increases the utilization of decorative jewelry ornaments in various manners.

It is another object of the present invention to provide decorative jewelry ornaments that function as pierced earrings without having to attach a post element for making it into an earring.

It is yet another object of the invention to provide an interchangeable jewelry assembly having a non-dedicated jewelry ornament and a plurality of different fastening elements for attaching the ornament to several different types of jewelry support devices in several different ways to create varying effects.

It is still another object of this invention to provide an interchangeable jewelry assembly having a non-dedicated jewelry ornament that may be combined with other jewelry ornaments to create varying jewelry designs.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an interchangeable jewelry assembly is provided which includes at least one jewelry element having a first side and a second side that is adapted for attaching to other jewelry elements or to jewelry support devices. A post is pivotally mounted on the second side such that it has at least two predetermined positions, an extended position for insertion into a pierced body part or fabric, and a retracted position whereby the post is substantially parallel and adjacent to the second side. A catch device also is disposed on the second side for fastening the free end of the post to the second side when the post is in its retracted position. When the post is fastened to the catch device, a loop is formed which may be used to attach the jewelry element to a jewelry support devices, such as a chain. Alteratively, one or more bales may also be disposed on the second side of the jewelry element for attaching to jewelry support devices. A fastening element may be provided for connecting the jewelry element to another jewelry element or to additional accessory pieces. The fastening element may take the form of a clip which cooperates with knobs, which are disposed on the second side of jewelry element and positioned adjacent the peripheral edge of the jewelry element to connect jewelry elements together. Preferably, a plurality of knobs are symmetrically disposed on each jewelry element so that multiple jewelry elements may be joined along abutting edges and held together by the interaction of the clip and knobs to form multiple jewelry combinations and designs.

In a preferred embodiment of the present invention, a pin frame having a pin attachment connected on one side is provided as a jewelry support device. The pin frame is shaped to releasably support a jewelry element, and when engaged within the pin frame, the jewelry element can be worn by the user.

BRIEF DESCRIPTION OF THE DRAWINGS

The accompanying drawings incorporated in and forming part of the specification illustrate several aspects of the present invention, and together with the description serve to explain the present invention. In the drawings.

DETAILED DESCRIPTION OF THE PREFERRED EMBODIMENT

Figure 1:
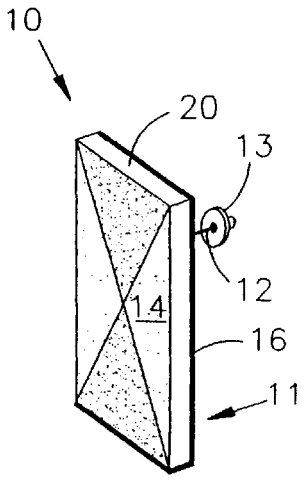
FIG. 1 is a perspective view of a jewelry element having the earring post in an extended position which is part of the interchangeable jewelry assembly constructed in accordance with the principles of the present invention.
Figure 1A:
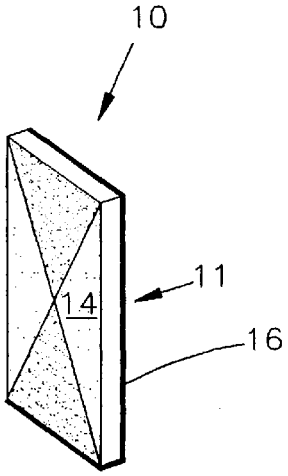
FIG. 1A is a perspective view of a jewelry element having the earring post in a retracted position.
Figure 2:
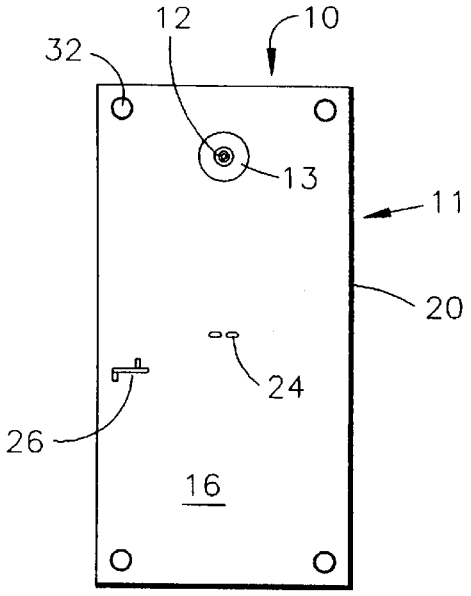
FIG. 2 is a back view of the jewelry elements of FIG. 1 having the earring posts in an extended position.

Referring now to the drawings where like numerals indicate like elements, FIG. 1 depicts an example of an interchangeable jewelry assembly in accordance with the principals of the present invention and generally designated by numeral 10 having an ornamental jewelry element 11 with two sides, a first side 14 which can be decorated, as desired, a second side 16 which is adapted for attaching the jewelry element 11 to the user, the user's clothing, other jewelry elements, and/or support devices, and a peripheral edges 20. As shown in FIGS. 2–2F, the second side 16 includes a post 12 which, as illustrated in FIGS. 1 and 2 can be extended for use so that jewelry element 111 can be used as a pierced earring whereby post 12 is inserted into a hole in the earlobe (not shown) of the user and a conventional earring securement nut 13 is circumferentially slipped onto the post 12 at a location behind the earlobe to secure the earring to the user. Although jewelry element 11 is discussed in terms of its use as an earring, it should be kept in mind that this invention and jewelry element 11 would work as well, and is intended to include use with any pierced body part (i.e. such as a pierced nose), and the use of the post 12 is not limited for use as a pierced ear. Post 12 also may be inserted into fabric, for example like a tie tack or through a button hole and secured by a securement nut 13. Alternatively, instead of having an earring post 12, a cuff link post (not shown) could be disposed on the second side 16.

Figure 2A:
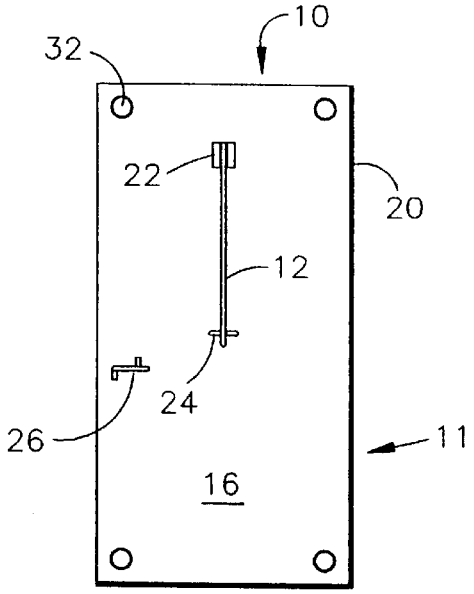
FIG. 2A is a back view of the jewelry element of FIG. 1A having the earring post in a retracted position.
Figure 4:
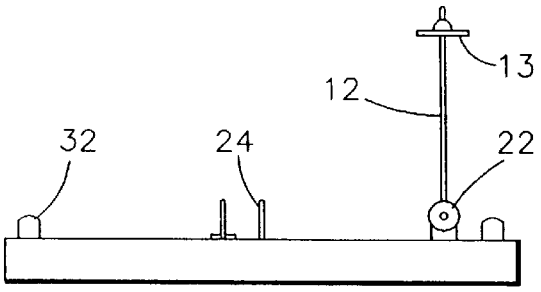
FIG. 4 is a side elevational view of the jewelry element of FIG. 2.
Figure 4A:
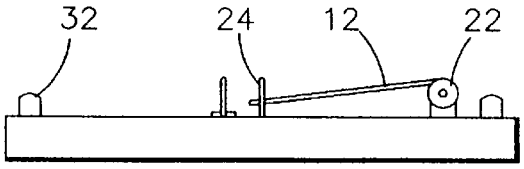
FIG. 4A is a side elevation view of the jewelry element of FIG. 2A.

Second side 16 of jewelry element 11 has a post 12 disposed thereon that is reciprocally mounted on the second side 16 so that it can be rotated to an extended position for use as an earring, as illustrated in FIGS. 2 and 4, or as illustrated in FIGS. 2A and 4A, it can be rotated to a retracted position substantially parallel and adjacent to second side 16 positioning post 12 so jewelry element 11 can have other uses as jewelry other than a pierced earring. Post 12 preferably is pivotally mounted to the second side 16 by a hinge 22, although any other suitable pivoting elements selected by those skilled in the art may be used.

Figure 2B:
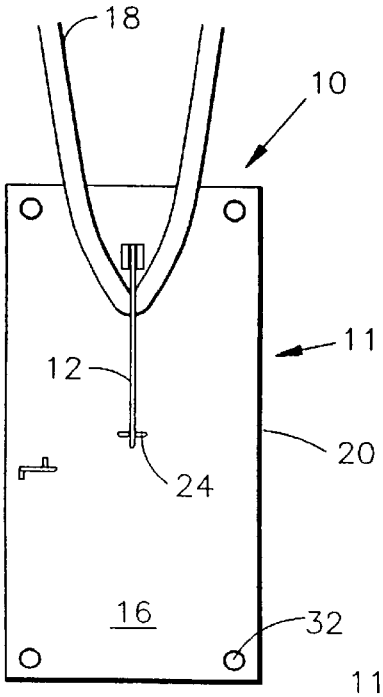
FIG. 2B is a back view of the jewelry element and chain support device of FIG. 1B.
Figure 2C:
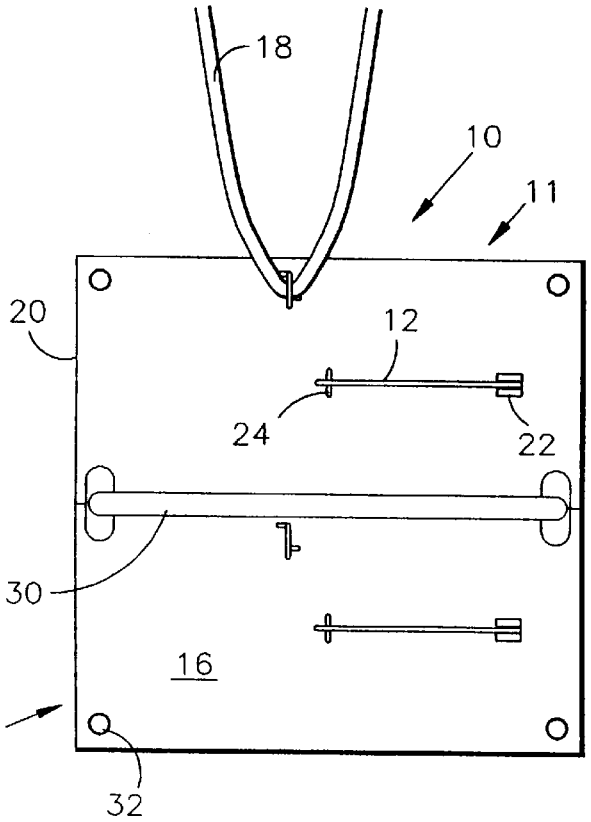
FIG. 2C is a back view of the jewelry elements and chain of FIG. 1C.
Figure 2D:
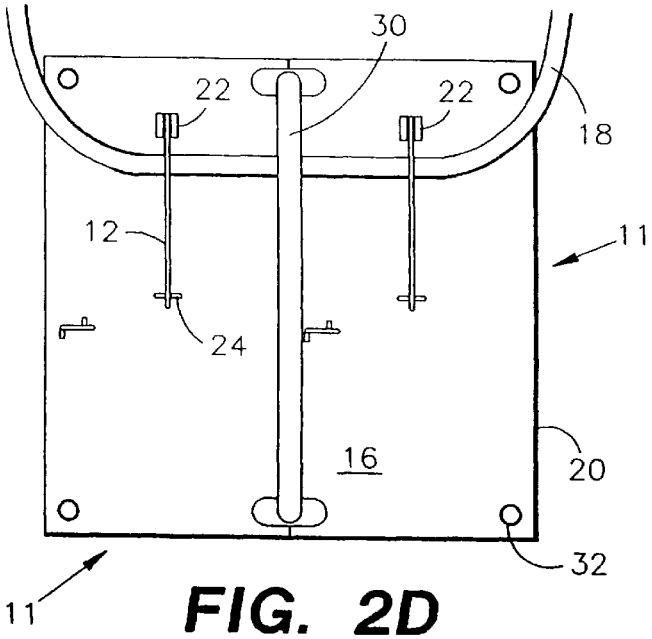
FIG. 2D is a back view of the jewelry elements and chain of FIG. 1D.
Figure 2F:
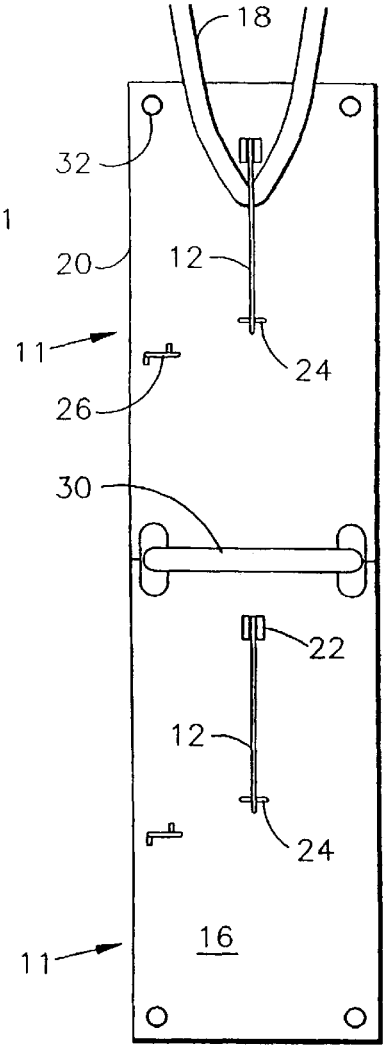
FIG. 2F is a back view of the jewelry elements and chain of FIG. 1F.
Figure 2E:
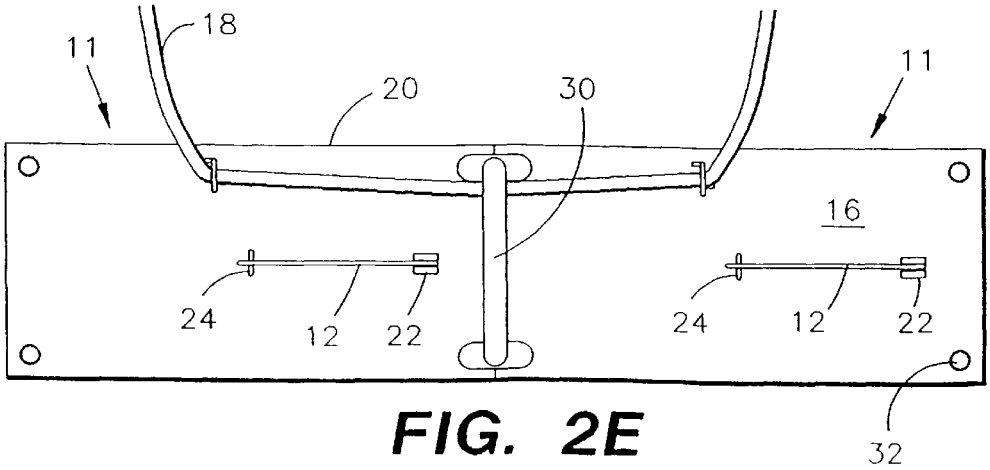
FIG. 2E is a back view of the jewelry elements and chain of FIG. 1E.
Figure 4B:
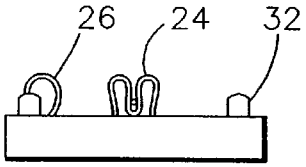
FIG. 4B is an end elevation view of the jewelry element of FIG. 2A.
Figure 4C:
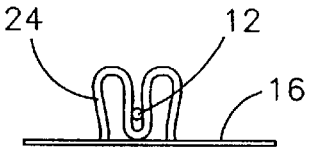
FIG. 4C is an enlarged view of the catch device of FIG. 2A having the post secured therein.

As highlighted by FIG. 4C, a catch device 24 is provided on the second side 16 for fastening the end of post 12 not attached to hinge 22 to the second side 16 so that the jewelry element 11 may be used without injuring the user or snagging the user's clothes. The post 12, when secured by the catch device 24, functions as a loop to which jewelry support devices may be secured, such as a chain 18, as shown in FIGS. 2B, 2D and 2F. As illustrated best in FIG. 4A, the loop formed by hinge 22, post 12, and catch device 24 is raised a sufficient distance from the second side 16 in order to allow support devices (e.g. chain 18) to be threaded between post 12 and second side 16.

In addition to the loop provided by hinge 22, post 12 and catch device 24, one or more bales 26 can be disposed on the second side 16 of each jewelry element 11 as a closed or substantially closed hook to form a loop and may be used for attaching the jewelry elements 11 to a support device such as chain 18 as shown in FIG. 2A. FIG. 4B illustrates a bale 26 being raised a sufficient distance from second side 16 so that a support device, such as chain 18, can be threaded therethrough.

A fastening element 30 is provided with the present invention so that the user can selectively connect jewelry elements 11 in a fixed interrelationship in a variety of arrangements to create varying jewelry designs. As shown in FIGS. 1C–1F and FIGS. 2C–2F, fastening element 30 may take the form of a clip for connecting jewelry together, or to additional accessory pieces. As discussed previously, knobs 32 are disposed on the second surface 16 adjacent the peripheral edges 20, as shown best in FIG. 2D, and are adapted to cooperate with clip 30 to releasably connect a plurality of jewelry elements 11 together.

Figure 3:
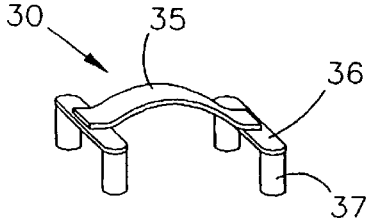
FIG. 3 is a perspective view of a fastening element of the present invention.

FIG. 3 illustrates a clip 30 which includes a beam 35 that has a slightly bowed configuration for ease of use, however, beam 35 can be provided in a more level configuration. Two supports 36 oppositely disposed on beam 35 are provided for supporting a plurality of connectors 37, which are cup-shaped, and are sized and configured to snugly releasably receive knobs 32 therein.

When fastening element 30 is used to selectively connect a plurality of jewelry elements 11 in a fixed interrelationship in a variety of jewelry designs, clip 30 can be releasably connected to knob 32, and when connected, extends along element 11 and between adjacent elements ll to connect elements 11 in a fixed interrelationship shown in FIGS. 2C–2F. Preferably, knobs 32 are symmetrically disposed on each element 11 so that as shown, multiple jewelry elements 11 may be joined in a fixed interrelationship along abutting peripheral edges 20 so that the edges are properly aligned (e.g. substantially flush and without noticeable space between jewelry elements 11), and are held together by the interaction of knobs 32 and clip 30 to form multiple combinations and designs of jewelry arrangements 10.

In lieu of wearing jewelry element 11 as earrings, jewelry elements 11 as part of the present invention can also be worn and utilized using various support devices.

A support device can include a chain 18 which can be attached and secured to one or more elements 11, and allows the present invention to be worn as a pendant for a necklace, bracelet, belt, or anklet, or similar jewelry or fashion accessory as shown in FIGS. 1B–1F and FIGS. 2B–2F. Chain 18 can be any type of stringing material which is strong enough to support one or more of the jewelry elements 11 and small enough to be threaded through the loops formed either by the hinge 22, post 12, and catch device 24, or by bale 26. Items such as metal chains, material cords, leather straps, or other suitable support devices for hanging jewelry elements 11 may be used. So that jewelry element(s) 11 hang substantially level when attached to chain 18, it is important that the elements disposed on second side 16 of element 11 (e.g., post 12, hinge 22, catch device 24, bales 26, and knobs 32) be positioned such that element 11 does not tilt to one side when chain 18 is threaded through either post 12 or bale 26.

Figure 1B:
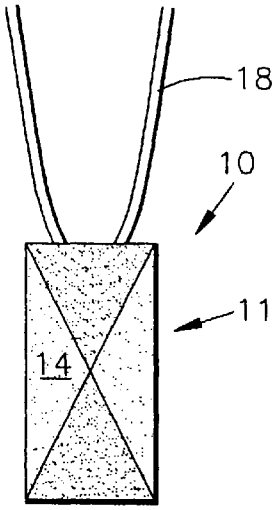
FIG. 1B is a front view of the jewelry element of FIG. 1 supported by a chain support device.
Figure 1C:
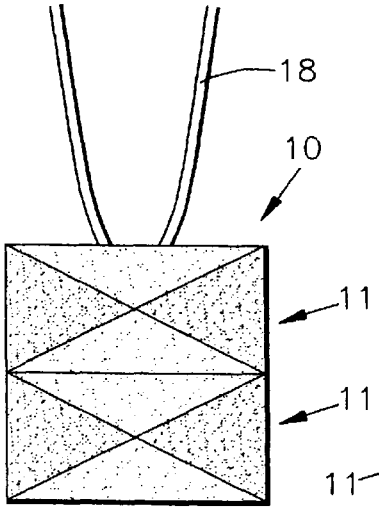
FIG. 1C is a front view of the jewelry elements of FIG. 1A attached in a side-to-side arrangement and supported by a chain threaded through a bale disposed on a side portion of the backside of one of the elements.
Figure 1D:
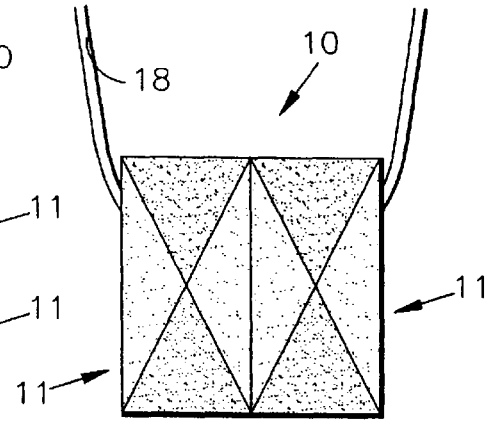
FIG. 1D is a front view of the elements of FIG. 1A attached in a side-to-side arrangement similar to FIG. 1C but supported by a chain threaded through the posts disposed on the backside of the elements.
Figure 1F:
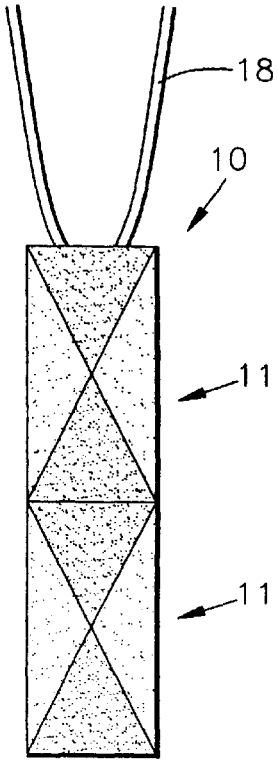
FIG. 1F illustrates the elements of FIG. 1A attached in an end-to-end arrangement similar to FIG. 1E, but depicting the elements supported by a chain strung through a post located on the backside of the topmost element.
Figure 1E:
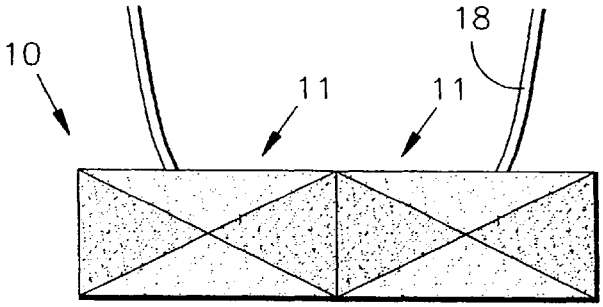
FIG. 1E illustrates yet another attachment arrangement for the jewelry elements of FIG. 1 in which the elements are attached end-to-end and are supported by a chain strung through bales and a clip disposed on the backside of the elements.

One skilled in the art may select from many suitable combinations and positions of fastening elements 30 so that jewelry elements 11 may be secured in various arrangements and/or to various support devices. Examples are shown in FIGS. 1B and 2B illustrate a preferred jewelry arrangement 10 in which a single element 11 is supported on a chain 18, which is threaded through a loop located on the second side 16 of the element 11. FIGS. 1C–F illustrate additional preferred arrangements in which attaching together several of the jewelry elements 11 of FIG. 1 are attached using fastening element 30 in conjunction with knobs 32 as shown in FIGS. 2C–2F, and support then an a chain 18 which is threaded through loops located on the second side 16 of both of the elements 11.

Figure 5A:
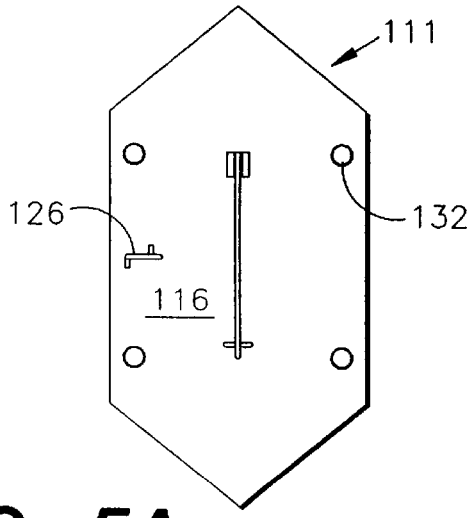
FIG. 5A is a back view of a marquis-shaped jewelry element.
Figure 5B:
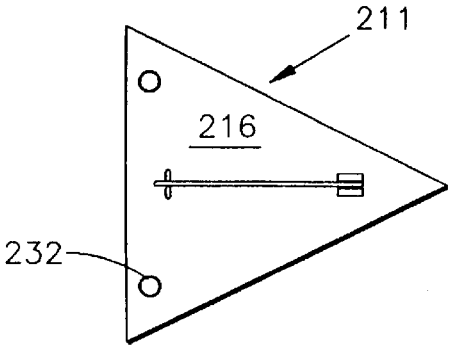
FIG. 5B is a back view of a triangle-shaped jewelry element.

Although the present invention has previously been illustrated in terms of rectangular shaped jewelry elements is, any shape jewelry elements may be used, and furthermore, it is possible to attach together jewelry elements that have different sizes, shapes, and/or configurations. FIG. 5A illustrates the second side 116 of a marquis shaped jewelry elements 111 and FIG. 5B illustrates triangle shaped jewelry element 211 that may be attached to or used in connection with the present invention. The showing of these two geometric configurations in FIGS. 5A and 5B is merely illustrative and non-limiting, and other shapes and designs can be used with the present inventions.

Figure 6:
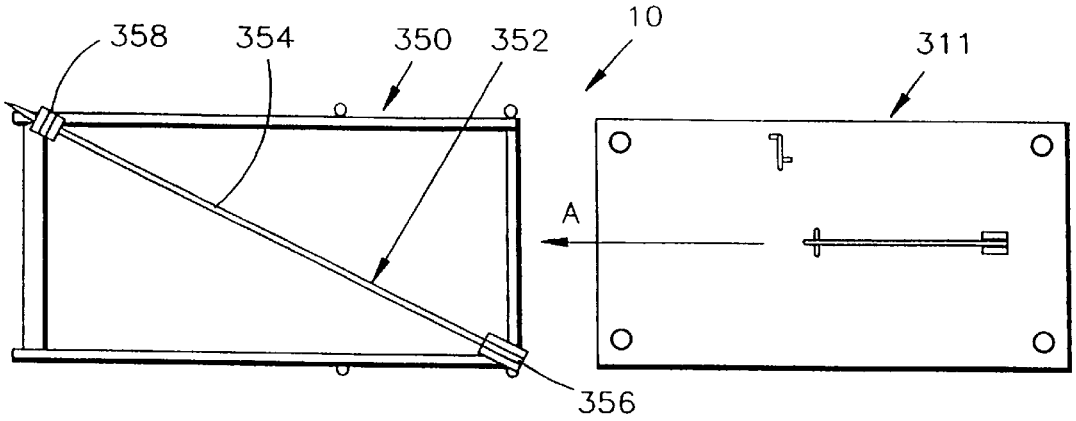
FIG. 6 is a back view of the jewelry element of FIG. 2A shown just prior to being slideably received in engaging the pin frame of the present invention.
Figure 6A:
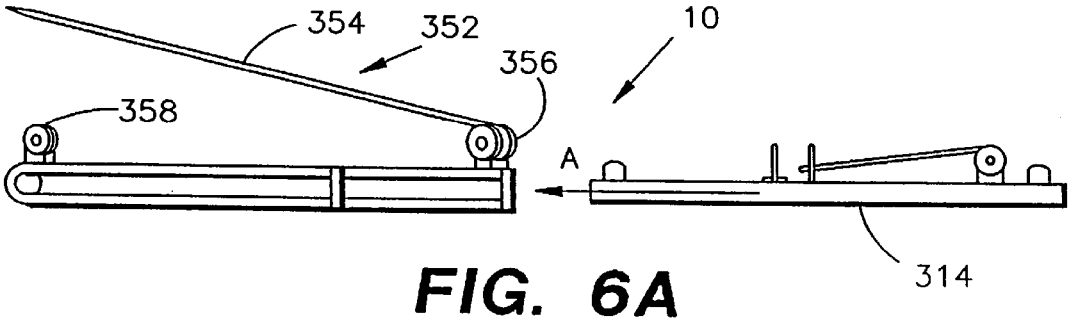
FIG. 6A is a side view of the jewelry element and pin frame of FIG. 6.

FIGS. 6 and 6A illustrate another embodiment of jewelry assembly 10 having a support device embodied as a pin support frame 350 that is sized and configured to support jewelry element 311 so that the first side 314 of element 311 can be displayed when inserted therein. Pin frame 350 is illustrated in FIGS. 6 and 6A as a broach, and includes a pin attachment 352 connected to one side of the pin frame 350 which has a first arm 354 that tapers to a point for inserting into a user's clothing. Pin attachment 352 also includes an attachment hinge 356 so that pin attachment 352 can pivotly rotate, and a catch device 358 for releasably securing the first arm 354 such that the pin jewelry assembly 10 is secured to the user's clothing. The pin support frame 350 can be provided in various sizes and configurations to accommodate jewelry elements of various sizes and configurations (e.g., 11, 111, 211). Alternatively, the support device could be provided as a stick pin design (not shown) rather than the broach design, as illustrated. To position jewelry element 311 within pin frame 350, element 311 is slideably inserted into an envelope space provided in pin frame 350, as shown by arrow "A" FIGS. 6 and 6A.

Figure 7:
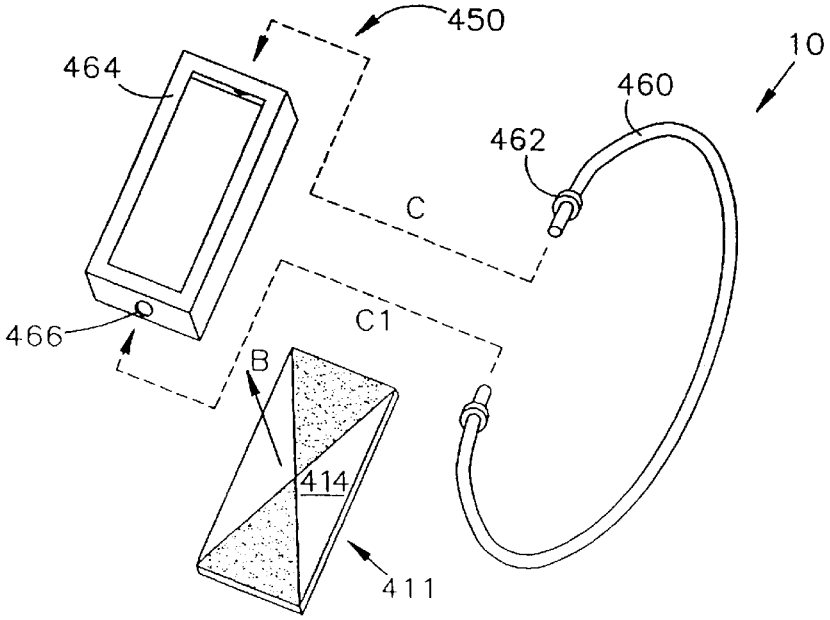
FIG. 7 is a perspective view of the jewelry element of FIG. 2A in conjunction with a support piece which connects to a frame for maintaining the jewelry element therein.

In an alternative embodiment illustrated in FIG. 7, interchangeable jewelry assembly 10 includes another support device 450 for supporting and displaying jewelry element 411, that includes a support piece 460 and a frame 464. The term support piece as used herein is not limited to a device that is worn around only the wrist, but is intended to include any partially closed ring-shaped article that can, be worn, for example, as a bracelet around a wrist, as a necklace around the neck, as an anklet around the ankle, or as a belt around the waist, or as other jewelry or fashion accessories depending on the size of the support device 450, and the support piece 460. Support piece 460 is configured as a partially closed article to allow the user to slip support piece 460 around his or her wrist and has a pair of oppositely disposed flanges 462 spaced slightly inward from the ends of 460.

Frame 464 is used in connection with support piece 460, and sized and configured to releasably receive jewelry element 411 therein. Jewelry element 411 is inserted into frame 464 as shown by arrow B, so that the element 411 is secured therein, and so that first side 414 is observable when support device 450 is worn by a user. Also, frame 464 has two holes 466 therein on oppositely disposed ends of frame 464 which are sized and configured to receive the ends of support piece 460 therethrough, as shown by arrows C and C1, which in turn, further secure element 411 in frame 464. Flanges 462 are sufficiently sized and configured so that they are not slideably insertable through holes 466.

An alternative of the present invention includes fastening elements which comprise complementary magnets (not shown) for attaching jewelry elements 11 to each other and to support devices. Portions of element 11 can be magnetized and preferably, the portions adjacent proximal edges 20 should be magnetized in this embodiment so that elements 11 can remain in a fixed interrelationship. The jewelry element 11 may have a magnetic fastening elements preferably have a post and a catch device for forming a loop, whereas magnetic accessory pieces only have magnetic fastening elements. To use as an earring or as a pin or broach, a magnet can be positioned behind the user (e.g., ear) or on the inside of the user's clothing to hold the jewelry element in position. The magnetic force created by the jewelry element the magnetic fastening element(s) must be sufficient to hold the pieces substantially together.

The foregoing description of a preferred embodiment of the invention has been presented for purposes of illustration and description. It is not intended to be exhaustive or to limit the invention to the precise form disclosed. Obvious modifications or variations are possible in light of the above-teachings. For example, jewelry elements 11, and others, can be used in connection with other support devices to provide other types of jewelry or fashion accessories not expressly mentioned herein. The above-described embodiments were chosen and described in order to best illustrate the principles of the invention and its practical application to thereby enable one of ordinary skill in the art to best utilize the invention in various embodiments and with the various modifications as are suited to the particular use contemplated.

What is claimed is:

1. An interchangeable jewelry assembly, comprising:

at least two jewelry elements, each of said elements having a second side;

a plurality of knobs disposed on each of second sides; and a clip configured for receiving at least one of said knobs on each of said second sides for selectively attaching said at least two jewelry elements together in a fixed interrelationship; and a movable post being directly attached to said second side of said element.

2. The assembly of claim 1, wherein said movable post has at least two predetermined positions, an extended position wherein said post is extended perpendicularly from said second side for insertion, and a retracted position wherein said post is moved such that said post is substantially parallel and adjacent to second side.

3. The assembly of claim 1, wherein said at least two jewelry elements further comprises a loop.

4. The assembly of claim 3, wherein said loop comprises a catch device disposed on said second side for selectively securing said post in said retracted position.

5. The assembly of claim 3, wherein said loop comprises at least one bale disposed on said second side.

6. The assembly of claim 1, wherein said assembly further comprises a support device.

7. The assembly of claim 6, wherein said support device is a chain.

8. The assembly of claim 1, wherein said post has at least two predetermined positions, and extended positions and a retracted position.

9. The assembly of claim 1, wherein said jewelry element further comprising at least one loop adapted for attached to said support device.

10. The assembly of claim 1, wherein said loop comprising a bale.

11. The assembly of claim 1, wherein said support device includes a chain insertable through said loop for wearing said at least one of jewelry element.

12. The assembly of claim 1, wherein said jewelry element comprising a first side, said first side having decorative indicia.

13. The assembly of claim 1, wherein said elements having a peripheral edges said plurality of knobs are disposed along the peripheral edge of said elements.

14. The assembly of claim 1, wherein said clip comprises a beam having a slightly bowed configuration.

15. The assembly of claim 1, comprising at least two supports oppositely disposed on said beam, wherein each of said supports comprises a plurality of connectors configured for releasibly receiving said knobs.

* * * * *

UNITED STATES PATENT AND TRADEMARK OFFICE

CERTIFICATE OF CORRECTION

PATENT NO. : 5,921,110
DATED : July 13, 1999
INVENTOR(S) : Suzanne Middendorff, et al.

It is certified that error appears in the above-identified patent and that said Letters Patent is hereby corrected as shown below:

In claim 1, line 4, insert --the-- before "second".

In claim 2; line 6, insert --the-- before "second".

In claim 8, line 2, replace "and extended" with --an extended--.

Signed and Sealed this

Twenty-eighth Day of December, 1999

*Attest:*

Q. TODD DICKINSON

*Attesting Officer*

*Acting Commissioner of Patents and Trademarks*